US006623203B2

(12) United States Patent
Kreyenborg et al.

(10) Patent No.: US 6,623,203 B2
(45) Date of Patent: Sep. 23, 2003

(54) CLAMP FITTING FOR FASTENING GLASS PLATES

(75) Inventors: Ralf Kreyenborg, Bad Salzuflen (DE); Dirk Schulte, Bad Driburg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/835,865

(22) Filed: Apr. 16, 2001

(65) Prior Publication Data

US 2002/0050108 A1 May 2, 2002

Related U.S. Application Data

(63) Continuation-in-part of application No. PCT/EP00/07941, filed on Aug. 15, 2000.

(30) Foreign Application Priority Data

Aug. 17, 1999 (DE) ..... 199 38 571

(51) Int. Cl.[7] ..... E06B 3/00; E04D 3/06

(52) U.S. Cl. ..... 403/374.3; 403/388; 52/208; 52/204.63

(58) Field of Search ..... 403/374.3, 388; 52/204.63, 208

(56) References Cited

U.S. PATENT DOCUMENTS 4,581,868 A * 4/1986 McCann ..... 52/204.593
4,689,928 A * 9/1987 Dutton et al. ..... 403/143
5,540,514 A * 7/1996 Demars et al. ..... 52/235
6,158,177 A * 12/2000 Blobaum ..... 52/208
6,254,397 B1 * 7/2001 Elmer ..... 52/235
6,430,894 B1 * 8/2002 Chae et al. ..... 52/786.1

FOREIGN PATENT DOCUMENTS

DE 19519527 A1 * 11/1996 ..... E04B/2/88
DE 29705481 8/1997
DE 19713678 10/1998
EP 506522 A1 * 9/1992 ..... E04F/13/08
GB 1343537 A1 * 1/1974
JP 11036496 A * 2/1999 ..... E06B/3/54

* cited by examiner

*Primary Examiner*—Lynne H. Browne
*Assistant Examiner*—Ernesto Garcia
(74) *Attorney, Agent, or Firm*—Nils H. Ljungman & Associates

(57) ABSTRACT

A clamp fixture to fasten glass plates that are clamped between an inner clamp element and an external clamp element, whereby a clamp bolt is supported elastically, to a limited extent, on the inner clamp element by means of a bush. The invention teaches that the inner clamp element, on the side facing the substructure, has a cylindrical receptacle space to hold the bearing that supports the clamp bolt in the axial direction, whereby the bearing is realized optionally in the form of a fixed bearing, in the form of a friction bearing that intersects the center longitudinal axis of the clamp bolt, or in the form of a movable bearing for the four-point bearing of a glass plate.

17 Claims, 8 Drawing Sheets

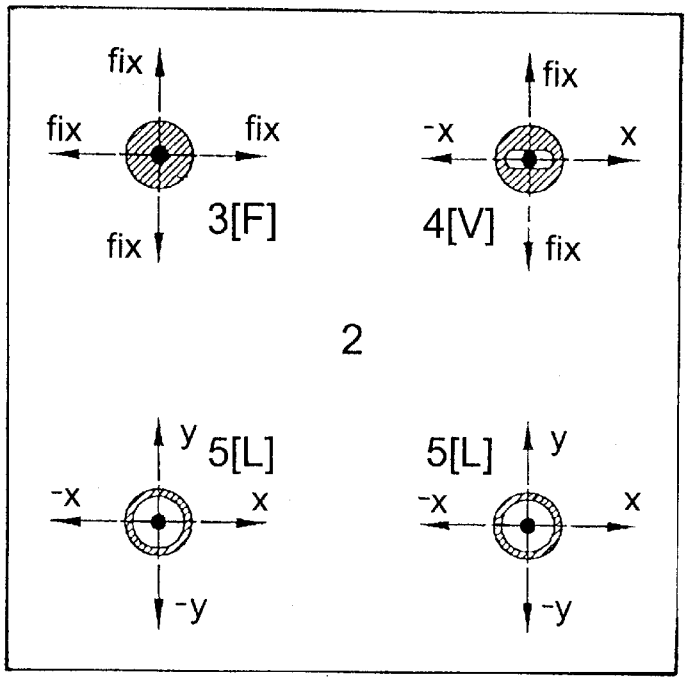
FIG. 1
Legend
FIG. 2
| | | | |
|---|---|---|---|
| [5] | Movable bearing | 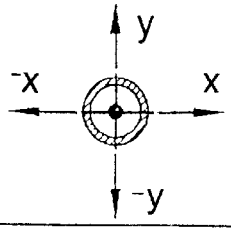  | Movement/Expansion in direction of x and y axis |
| [4] | Vertical bearing | 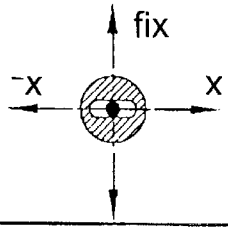  | Movement/Expansion in direction of x axis |
| [3] | Fixed bearing | 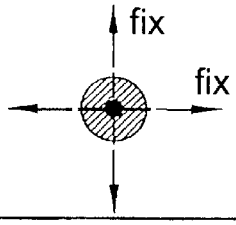  | No Movement/Expansion in direction of x and y axis |

[3]

[4]

[5]

CLAMP FITTING FOR FASTENING GLASS PLATES

CONTINUING APPLICATION DATA

This application is a Continuation-In-Part application of International Patent Application No. PCT/EP 00/07941, filed on Aug. 15, 2000, which claims priority from Federal Republic of Germany Patent Application No. 199 38 571.4, filed on Aug. 17, 1999. International Patent Application No. PCT/EP 00/07941 was pending as of the filing date of this application. The United States was an elected state in International Patent Application No. PCT/EP 00/07941.

BACKGROUND OF THE INVENTION

1. Field of the Invention

This invention relates to a clamp fitting for fastening glass plates with an outer and an inner clamp element that clamp the glass plate between them and a clamp bolt that can be connected with a substructure, which clamp bolt is supported elastically, to a limited extent, on the inner clamp element by means of a bush that surrounds the clamp bolt.

2. Background of the Invention

A device of the type described above is disclosed in Federal Republic of Germany Patent Application No. 197 13 678 A1. On this clamp fixture of the prior art, a clamp element on the inside of the building is connected to a bush that surrounds the clamp bolt, which bush is elastically supported by O-rings on a flange of the clamp element on the inside of the building. This support is primarily to absorb the stresses that are exerted on the glass plate after installation. However, the support also makes it possible to adjust the glass plate and/or the clamp elements that are enclosing the glass plate relative to the position of the clamp bolt that can be connected with the substructure if, in the realization of the prior art, a distance bolt that surrounds the clamp bolt is located at a variable angle with respect to the clamp element on the inside of the building. The result is a limited relative movement of the clamp element on the inside of the building with respect to the bolt shank of the clamp bolt in all six degrees of freedom.

The invention is based on the observation that glass plates, for example those used to cover facades, are fastened by means of a four-point bearing. It is thereby desirable to first connect the glass plate to the substructure by means of a fixed bearing point, whereby the other three bearing points must be equipped so that both construction tolerances as well as loads on the glass plate after installation caused by thermal stresses or wind pressure can be reliably absorbed. This capability necessarily requires a different configuration of the individual clamp fittings.

OBJECT OF THE INVENTION:

The object of the invention, taking the requirements described above into consideration, is to realize the individual clamp fittings for the four-point bearing so that essentially identical components can be used to the greatest possible extent to arrive at a solution that is economical and easy to install.

SUMMARY OF THE INVENTION:

The invention teaches that this object can be accomplished by a clamp fixture for fastening glass plates with an outer clamp element and an inner clamp element that clamp the glass plate between them and a clamp bolt that can be connected with a substructure, which clamp bolt is supported elastically, to a limited extent, on the inner clamp element by means of a bush that surrounds the clamp bolt, characterized by the fact that the inner clamp element (6), on the side facing the substructure, has a cylindrical receptacle space (10) to hold a bearing (3, 4, 5) that supports the clamp bolt (8) in the axial direction (Arrow Z), whereby the clamp bolt (8) can be supported optionally in the axial direction (Arrow Z) without play (fixed bearing), in a plane that intersects the center longitudinal axis (11) and in the axial direction (Arrow Z) with play (12, 13) (friction bearing 4), or with axial play (14) and play (15) on all sides in the peripheral direction (movable bearing 5) in the bearing (3, 4, 5).

The present invention teaches that an inner clamping element, on the side facing the substructure, has a cylindrical receptacle space to hold a bearing that supports the clamping bolt in the axial direction, whereby the clamp bolt can be supported in the bearing optionally in the axial direction with no play, in a plane that intersects the center longitudinal axis and in the axial direction with play, or with axial play and peripheral play in all directions.

The invention teaches the use in all cases of a clamp element of essentially identical construction on the outside of the building and on the inside of the building. With the first partial characteristic, namely the realization of the bearing such that the clamp bolt can be supported in the bearing in the axial direction without play, a fixed bearing is created.

With the second partial characteristic, namely the support of the clamp bolt in the clamp element on the inside of the building in a plane that intersects the center longitudinal axis and in the axial direction with play, a vertical bearing or friction bearing is created which, even after installation, allows a movement of the clamp bolt with respect to the clamp bolt on the inside of the building in a plane.

With the third partial characteristic, namely the mounting of the clamp bolt in the clamp element on the inside of the building with axial play and peripheral play on all sides, a movable bearing is finally created that allows a movement of the pane with respect to the clamp fitting both in the horizontal and in the vertical direction, i.e. for example in an X plane or in a Y plane.

With the solution claimed by the invention, different degrees of freedom for the clamp bolt supported in the above mentioned bearing are created merely by slightly modifying the configuration of the bearing held by the inner clamp element, without requiring a modification to the clamp element on the inside of the building. Thus a tolerance compensation is possible both during installation as a result of manufacturing tolerances, and after installation as a result of stresses that act on the glass plate.

Additional characteristics of the invention are disclosed herein below in the features of the invention.

The invention teaches that the bearing is realized so that it has a compensating bush that surrounds the bolt shank of the clamp bolt without play and a spacer bush that surrounds the compensating bush, whereby the spacer bush has on its outside periphery a flange by means of which the bearing is supported elastically, to a limited extent, by elastic means, for example by O-rings on the inner clamping element. This support allows limited vertical adjustability, for example plus or minus two millimeters, even in the fixed bearing.

To achieve a fixed bearing, the invention teaches that the compensating bush is fixed in position in the axial direction on the spacer bush without play, whereby the compensating bush is supported on one hand on a collar of the spacer bush and on the other hand by means of a nut that is screwed onto the spacer bush with the compensating bush. To thereby substantially eliminate all play, a distance washer is located between the nut and the end surface of the spacer bush. Thus—apart from the support of the bearing by means of the O-rings described above, all movement of the clamp bolt with respect to the clamp element on the inside of the building is prevented.

The invention further teaches that the spacer bush has a recess or boring with a hole-like cross section, whereby the compensating bush is supported by means of an essentially oval or elliptical bush head on a collar of the spacer bush. In the fixed bearing described above, a displacement or travel of the clamp bolt in the slot-like recess of the compensating bush is reliably prevented by the axial clamping, while the invention further teaches that to achieve a friction bearing, there is axial play between the nut that is screwed to the compensating bush and the spacer bush. As a result of the omission of the axial clamping, the compensating bush can slide into the slot-like recess of the spacer bush even after installation, so that the result is a compensation capability in a plane that intersects the center longitudinal axis of the clamp bolt.

As will be explained in greater detail below with reference to the exemplary embodiment, this is achieved by omitting the above mentioned distance washer associated with the fixed bearing, so that the only constructive difference between the fixed bearing and the friction bearing or vertical bearing is the omission of the distance washer.

A slight constructive modification of the configuration of the bearing results in the achievement of a movable bearing, whereby, however, the clamp element on the inside of the building described above is used in an identical fashion. To achieve a movable bearing, both the compensating bushes and the spacer bush have concentric borings, whereby the spacer bush surrounds the compensating bush with radial play and is mounted with axial play between the bolt head of the clamp bolt and a flange of the compensating bush. The constructive difference therefore comprises the configuration of the spacer bush on the one hand and the compensating bush on the other hand, although it essentially guarantees a movement of the clamp bolt with respect to the clamp element on the inside of the building in four degrees of freedom.

In all three embodiments, both with the fixed bearing, the friction bearing and the movable bearing, the compensating bush has a threaded sleeve that points toward the substructure, which threaded sleeve holds a locknut that is pressed against the substructure.

The result of the invention is the creation of a clamp fitting with which, while retaining essentially identical components, different degrees of freedom of the clamp fitting with respect to the glass plate can be achieved.

In other words, the present invention broadly teaches that a glass pane can be fastened to a substructure by means of four clamp fittings (one in each corner of the glass pane) each comprising an outer clamp element and an inner clamp element. The four clamp fittings are substantially identical, however, there are differences in functionality: a fixed bearing with limited vertical adjustability, probably, in at least one possible embodiment, plus or minus two millimeters, a vertical bearing (also referred to as a friction bearing with play in a vertical direction), and two movable bearings probably in four degrees of freedom. Slight constructive modifications of the configuration of the bearings are necessary in order to allow for the differences in functionality. These slight modifications enable the usage of identical components in the three different bearings to be used at the greatest possible extent. The invention is therefore an economical solution as well as a user-friendly product.

The above-discussed embodiments of the present invention will be described further hereinbelow. When the word "invention" is used in this specification, the word "invention" includes "inventions ", that is the plural of "invention". By stating "invention ", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below on the basis of three exemplary embodiments illustrated in the accompanying figures, in which:

FIG. 1: is a schematic view of a four-point bearing

FIG. 2: is the legend for the individual clamp fittings illustrated in FIG. 1.

DESCRIPTION OF THE PREFERRED EMBODIMENT

Figure 4:
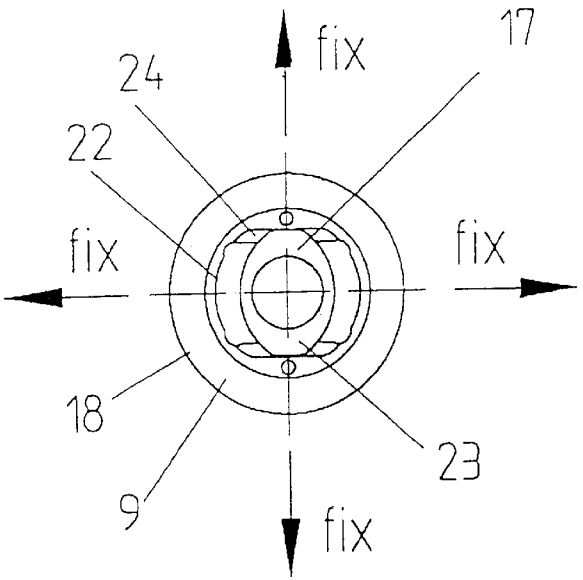
FIG. 4: is a view of the embodiment illustrated in FIG. 3 in the direction of Arrow A—A.

In FIG. 1, on a glass plate designated as 2, there are a fixed bearing 3, a friction or vertical bearing 4, and two loose bearings 5, by means of which the glass plate 2 is fastened to a substructure (not shown). The fixed bearing designated F can be adjusted only to the extent of the play that is conventional in bearing parts, e.g. by plus or minus approximately two millimeters, on account of the support of a spacer bush 9 by means of O-rings 30 that are described below. The vertical bearing designated V permits movement only in a plane through a center longitudinal axis 11 of the fastening bolt, whereby this plane can be oriented as desired, for example, in the X direction or in the Y-direction. The movable bearing designated L, on the other hand, permits a movement of the fastening bolt orthogonally with respect to the center longitudinal axis 11 of the bolt in all directions.

Figure 3:
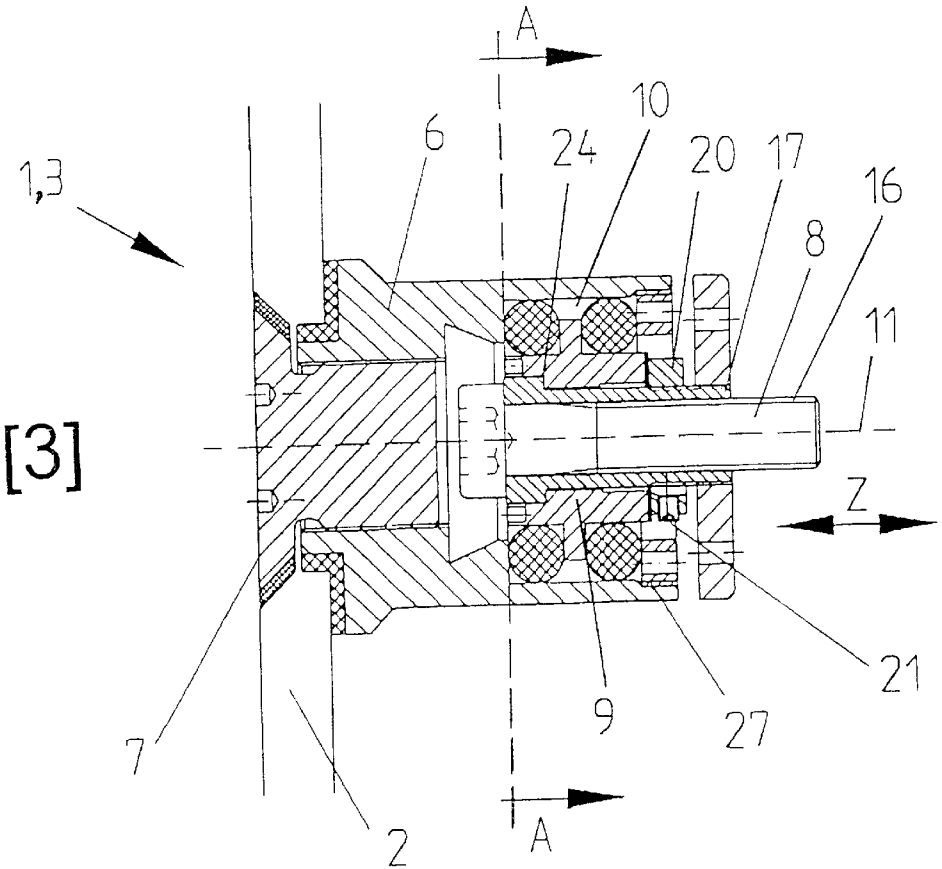
FIG. 3: is a cross section through a fixed bearing.

The fixed bearing 3 shown in cross section in FIG. 3, like the friction bearing 4 and the movable bearing 5, has an inner clamp element 6 and an outer clamp element 7. On the side of the clamp element 7 directed toward the substructure (not shown), the clamp element 7 has a cylindrical receptacle space 10 that holds the actual fixed bearing 3. The fixed bearing 3 comprises essentially a compensating bush 17 that surrounds the clamp bolt 8 and the spacer bush 9 that surrounds the compensating bush 17, which spacer bush 9 has a recess or boring 22 with a slot-shaped recess (See FIG. 4). The compensating bush 17, on its free end toward the substructure (not shown), an external screw thread onto which a nut 20 is screwed. Between the nut 20 and the end surface of the spacer bush 9 facing the nut 20 there is a distance washer 21, by means of which the spacer bush 9 is clamped with the compensating bush 17 and thus with the clamp bolt in the axial direction of the clamp bolt 8 (Arrow Z).

The spacer bush 9 also has a flange 18 (See FIG. 5), which is engaged between two O-rings (30), which, for their part, are fixed in position by means of a clamping ring (tension ring) 27 which is screwed into an internal screw thread of the inner clamp element 6. The clamp bolt 8 clamped as described above is supported with its oval—or elliptically-shaped bush head 23 on a collar 24 of the spacer bush 9.

Figure 6:
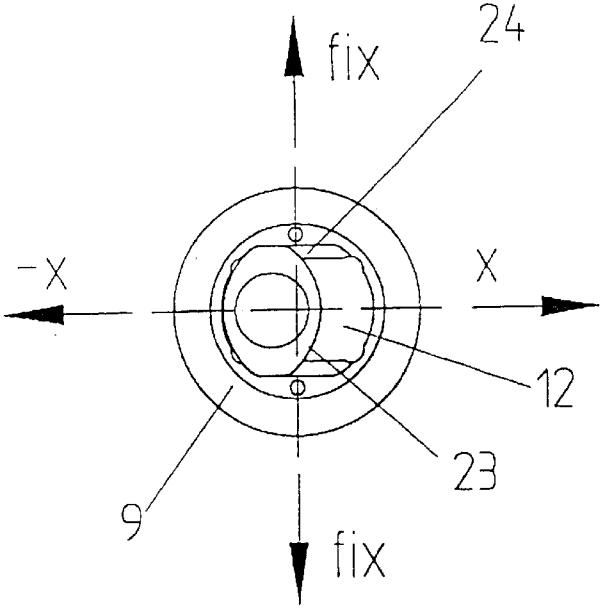
FIG. 6: is a view of the embodiment illustrated in FIG. 5 in the direction of Arrow B—B.
Figure 5:
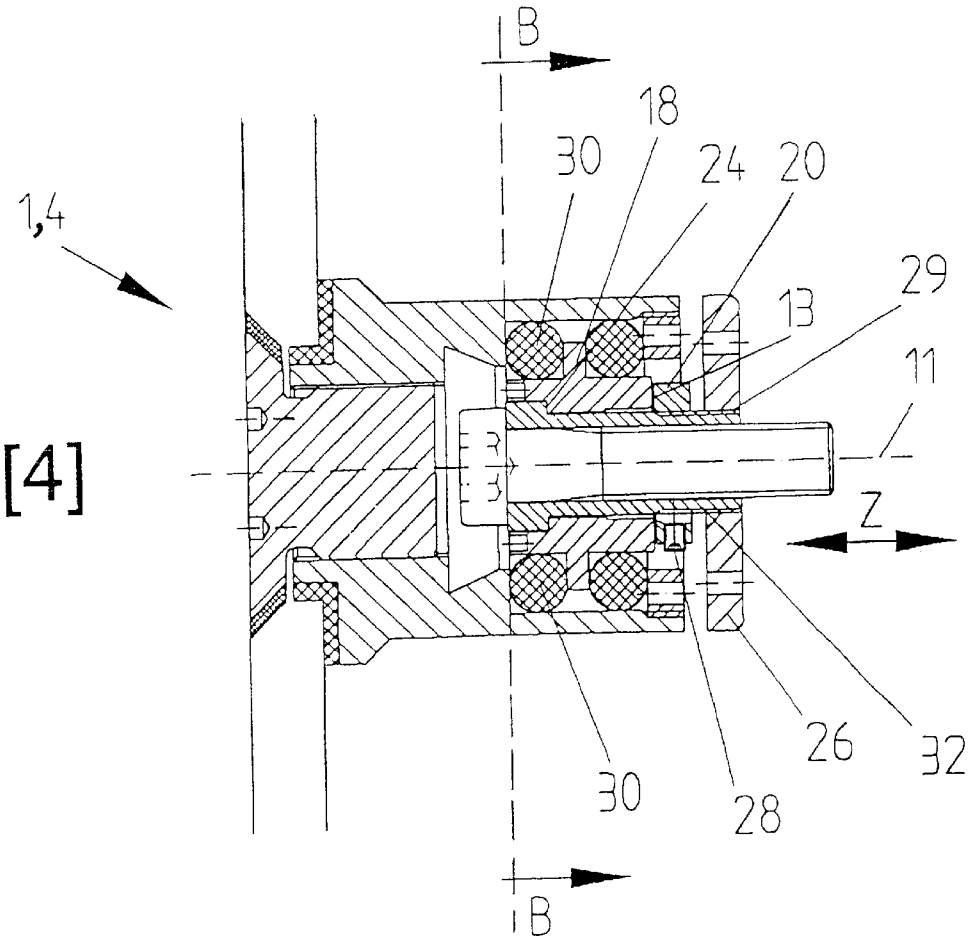
FIG. 5: is a cross section through a friction bearing or vertical bearing.

The exemplary embodiment illustrated in FIGS. 5 and 6 shows the realization of a vertical or friction bearing in which the clamp bolt 8 is guided with its bush head 23 so that it slides in the slot-like recess 22 of the spacer bush 9. The result is a lateral displacement capability for the clamp bolt 8 in the X-direction shown in FIG. 6 in the context of a play designated as 12. For this purpose, the distance washer 21 described with reference to FIG. 3 has been removed, so that there is an axial play designated 13 of the spacer bush 9 between the collar 24 of the spacer bush and the nut 20.

For this purpose, a thread designated 29 on the outside periphery of the compensating bush 17 is sized so that the nut 20 can be tightened against the end stop of the thread 29. The nut 20 can also be fixed in its end position by a stud screw 28.

Figure 8:
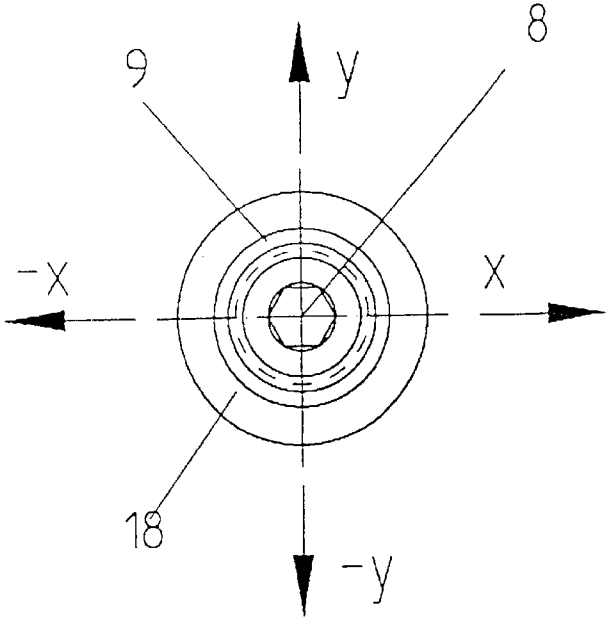
FIG. 8: is a view of the embodiment illustrated in FIG. 7 in the direction of Arrow C—C.
Figure 7:
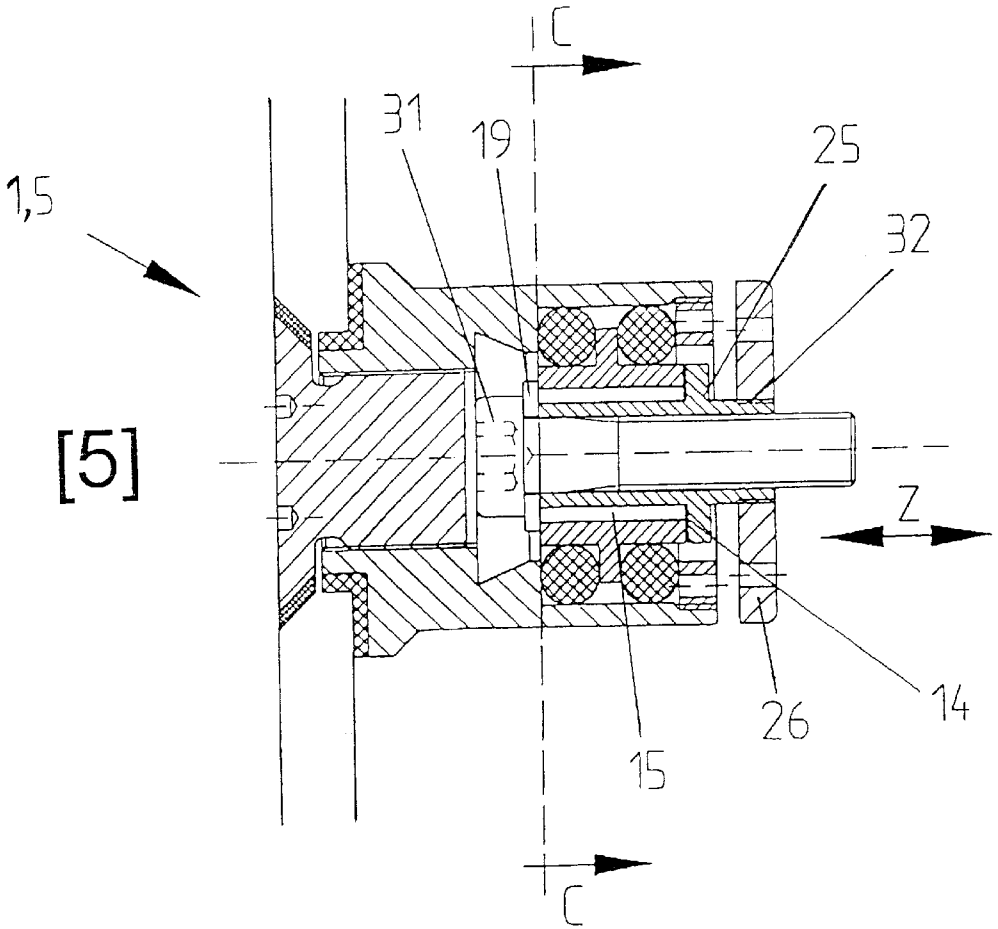
FIG. 7: is a cross section through a movable bearing.

FIGS. 7 and 8 show a clamp fitting 1 realized in the form of a movable bearing 5, i.e. the compensating bush 17 and the spacer bush 9 concentrically surround a bolt shank 16 of the clamp bolt 8. For that purpose, the compensating bush 17 has a flange 25 between which flange 25 and a shim washer 19, which shim washer 19 is in contact with the screw (or bolt) head 31 of the clamp screw (or bolt) 8, the spacer bush 9 is located with radial play 14 and axial play 15. This makes possible both a slight axial movement (Arrow Z) as well as a radial movement of the clamp bolt 8 within the inner clamp element 6, as indicated in FIG. 8 by the arrows X and Y.

In the vicinity of the free end of the compensating bush 17 pointing toward the substructure 101 there is a threaded sleeve 32 onto which a locknut 26 that can be adjusted in relation to the substructure by means of the screw thread 29 is screwed.

In other words, the present invention broadly teaches that a glass plate (2) can be fastened to a substructure (101) by means of four clamp fittings (1)(one in each corner of the glass plate) each comprising an outer clamp element (7) and an inner clamp element (6). The four clamp fittings (1) are by and large identical, however, as seen in FIG. 1 there are differences in functionality that offers different degrees of freedom for the clamp bolt (8). A fixed bearing (3) with limited vertical adjustability, probably plus or minus two millimeters, a vertical bearing (V) (also referred to as a friction bearing (4) with play in a vertical direction), and two movable bearings (5) probably in four degrees of freedom. Slight constructive modifications of the configuration of the bearings are necessary in order to allow for the differences in functionality, these slight modifications enable the usage of identical components in the three different bearings to be used at the greatest possible extent.

Figure 9:
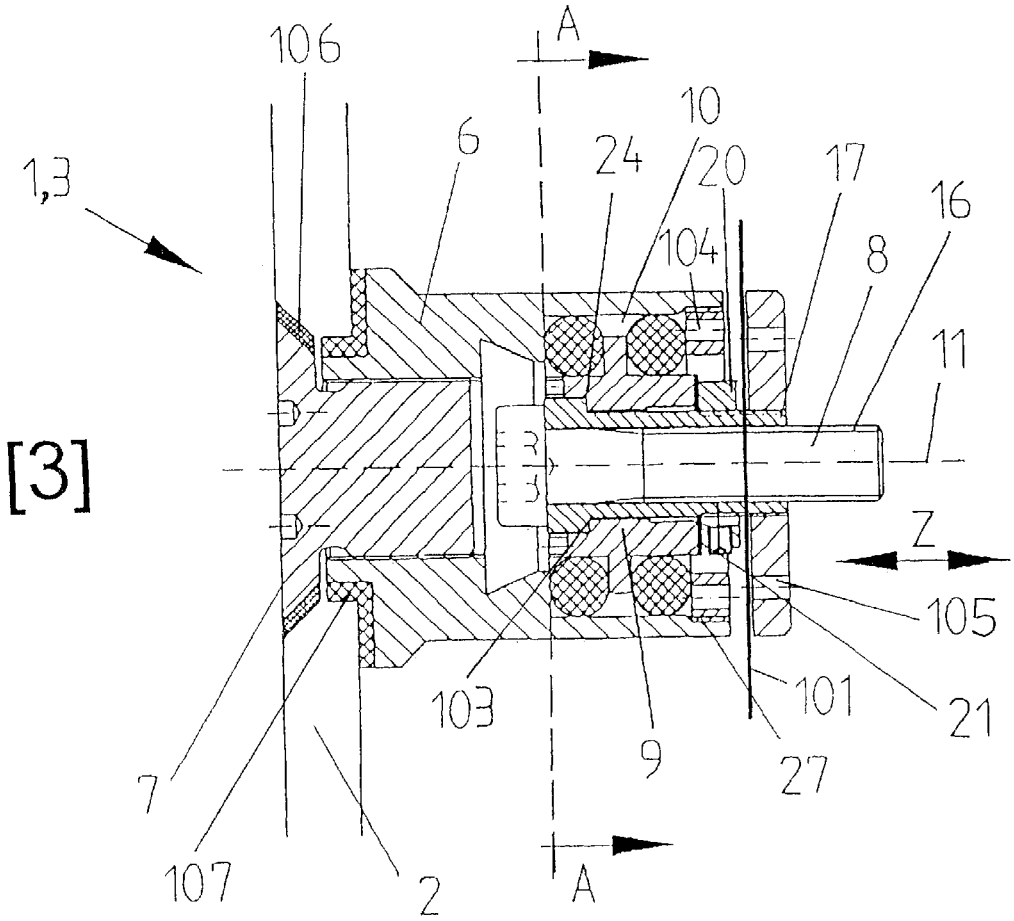
FIG. 9: is a cross section through a fixed bearing, which is representative of all the bearings.

FIGS. 3, 4, 5, 6, 7, 8 and 9 broadly show a clamp fitting (1) with an outer clamp element (7) and an inner clamp element (6) between which a glass plate (2) is clamped. Further, FIG. 9 shows the substructure (101) to which the bearings (3, 4 and 5) are connected by means of a locknut (26). The previously mentioned constructive modifications of the configurations of the bearings (3, 4 and 5) are possibly all in the inner clamp element (6).

FIGS. 3 and 9 broadly show a fixed bearing (3) in which a clamp bolt (8) is surrounded by a compensating bush (17) and a spacer bush (9) that surrounds said compensating bush (17). Both the compensating bush (17) and the surrounding spacer bush (9) preferably have a small collar or flange (102 and 103) that broadly fit into each other for support.

To possibly eliminate all play, a distance washer (21) is placed at the end surface of the spacer bush (9) (facing the substructure (101)), and a nut (20) broadly screws onto the thread of the compensating bush (17) clamping the distance washer (21) with the spacer bush (9). To further ensure that the fixed bearing (3) has no play a stud screw (28) can fix the nut (20) in its end position.

The spacer bush (9) possibly has a flange (18) which is engaged between two rows of O-rings (30), the flange (18) however, does not completely separate the rows of O-rings (30) but preferably leaves a cylindrical receptacle space (10), which space (10) together with the O-rings probably allows a limited vertical adjustability plus or minus two millimeters. To preferably keep the O-rings (30) in place a tension ring (27) is screwed into the inside of the inner clamp element (6). Both the tension ring (27) and the locknut (26) probably has an adequate number of screw holes (104 and 105), so once the inner clamp element (6) has been placed and fastened with the locknut (26) small bolts can preferably be screwed from the inside of the substructure (101) through both locknut (26) and the substructure (101) itself and into the tension ring (27) and thereby ensure the immobility of both the locknut (26) and the tension ring (27).

FIG. 5 broadly shows a vertical bearing (V) also referred to as a friction bearing (4). The vertical bearing (V) is probably almost exactly identical in construction as the fixed bearing (3), with only one small difference, namely the omission of the distance washer (21) whereby an axial clamping is possibly eliminated. The elimination of the axial clamping will broadly permit movement through the center longitudinal axis (11) and thereby possibly allow for a choice of direction (in the X-direction or the Y-direction) depending on the need.

FIG. 7 broadly shows a movable bearing (5). The object of the movable bearing (5) is possibly to realize a bearing with both axial play and radial play. The axial play is preferably achieved by omitting the distance washer (21) (as in the friction bearing (4)). The radial play, however, is broadly achieved by a constructive difference in the configuration of both the spacer bush (9) and the compensating bush (17).

As shown in FIG. 7, in this case both the spacer bush (9) and the compensating bush (17) are possibly realized without collar (102 and 103). The omission of the collars (102 and 103) possibly render essentially impossible for the spacer bush (9) and the compensating bush (17) to rest on each other and instead the omission makes room for a play (15). Furthermore, the compensating bush (17) possibly has a flange (25) which together with the shim washer (19) surrounds the spacer bush (9).

These constructive differences in the configuration of both the spacer bush (9) and the compensating bush (17) will broadly allow for the desired radial play.

FIG. 9 shows the mounting of a glass plate (2) by means of the bearings (3, 4 and 5) to a substructure (101) can possibly be done two ways. In the first case the inner clamp elements (6) of the different bearings (3, 4 and 5) should preferably be fastened and secured to the substructure (101) and once the four inner clamp elements (6) are in place, the glass plate (2) can broadly be mounted by screwing the outer clamp element (7) through the glass plate (2) and into the inner clamp element (6). In the second case the four bearings (3, 4 and 5) are first connected to the glass plate (2) and then the bearings (3, 4 and 5) are connected, fastened and secured to the substructure (101). In both cases the fixed bearing (3) should broadly be installed first, secondly the vertical bearing (V) also referred to as the friction bearing (4) should be installed, and finally the two movable bearings probably without any individual order can be installed. To be able to fully exploit the flexibility this invention offers it preferably necessary to apply this order of installation.

In order to protect the glass plate (2) from being damaged by the clamp fittings both (1) during installation as well as after installation due to possible thermal stresses and wind pressure, the outer clamp element (7) and inner clamp element (6) where touching the glass plate (2) should both preferably be fitted with a protecting sleeve or a tight bushing (106 and 107) made out of e.g. Teflon, neoprene, nylon, plastic or rubber.

Figure 3A:
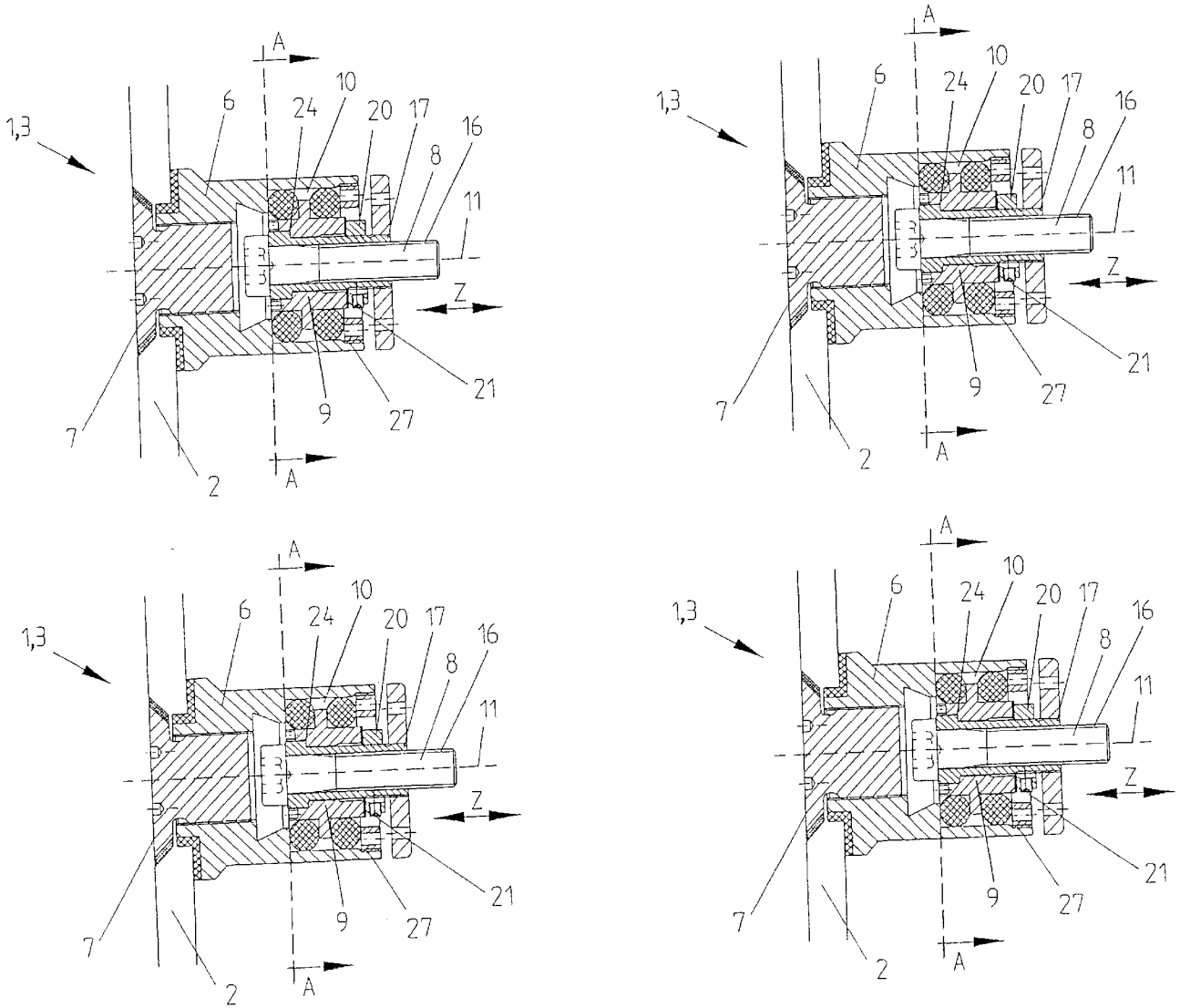
FIG. 3A: is a view of a plurality of fixed bearings, each of which is the same as that shown in FIG. 3.

FIG. 3A shows a plurality of fixed bearings, each of which is the same as that shown in FIG. 3.

Figure 5A:
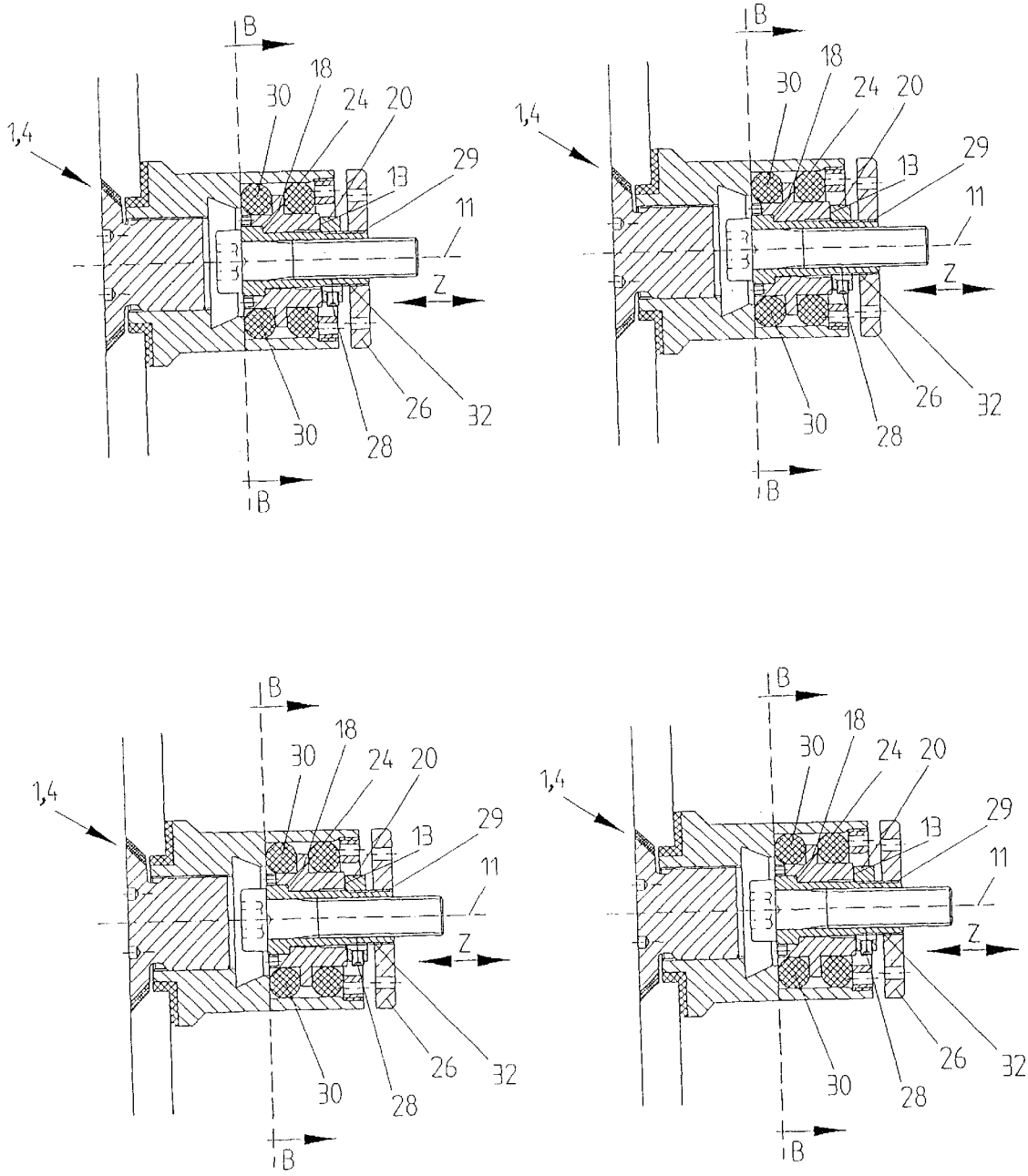
FIG. 5A: is a view of a plurality of friction bearings, each of which is the same as that shown in FIG. 5.

FIG. 5A shows a plurality of friction bearings, each of which is the same as that shown in FIG. 5.

Figure 7A:
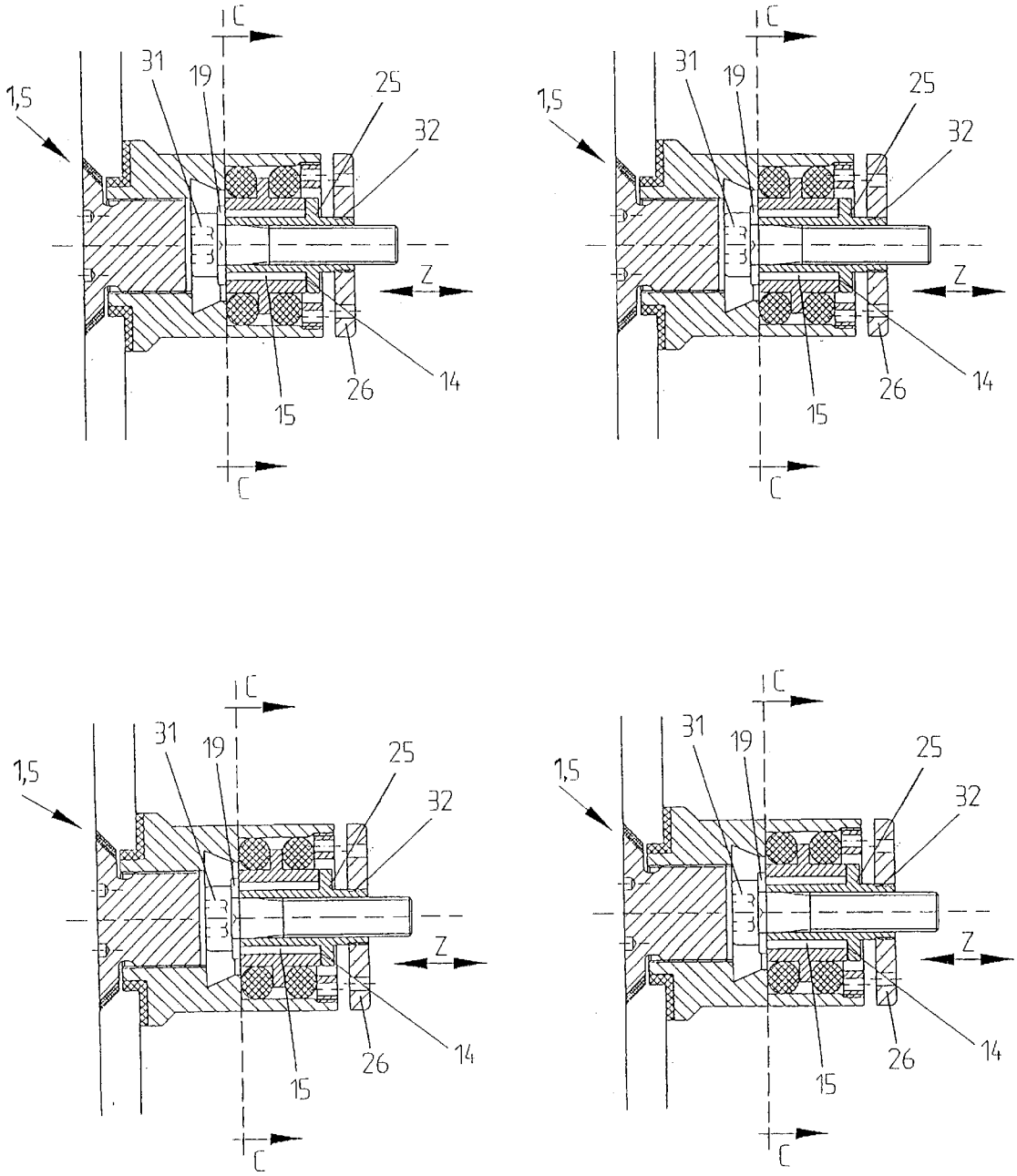
FIG. 7A: is a view of a plurality of movable bearings, each of which is the same as that shown in FIG. 7.

FIG. 7A shows a plurality of movable bearings, each of which is the same as that shown in FIG. 7.

One feature of the invention resides broadly in a kit to mount a glass plate (2) in a glass facade to a building structure, said kit comprising: a first clamping assembly (3), a second clamping assembly (4), and a third clamping assembly (5); each said clamping assembly (3, 4, 5) comprising: a structure being configured to operatively mount a corresponding clamping assembly (3, 4, 5) to a building structure; said building mounting structure comprising: a clamp bolt (8) being configured to be operatively connectable to a building structure; and a bush arrangement (9, 17) being configured to be operatively connectable to said clamp bolt (8); each said clamping assembly (3, 4, 5) comprising: a glass plate supporting assembly (6, 7) being configured to be operatively connectable to said building mounting structure, and said glass plate supporting assembly (6, 7) being configured to support a glass plate (2) adjacent to a building structure; said glass plate supporting assembly (6, 7) comprising: a first clamp element (7) configured to be disposed away from a building structure upon installation with a glass plate (2) to a building structure; and a second clamp element (6) configured to be disposed between said first clamp element (7) and a building structure upon installation with a glass plate (2) to a building structure; said second clamp element (6) comprising a cylindrical recess (10) configured to operatively mount therein said clamp bolt (8) and said bush arrangement (9, 17); each said clamping assembly (3, 4, 5) further comprising: an arrangement (30) to provide elasticity between a building structure and a connected glass plate (2), said elastic arrangement (30) being configured to be operatively connectable to said bush arrangement (9, 17) of said building mounting structure, and said elastic arrangement (30) comprising an elastic material; said elastic material being configured to minimize stresses on a connected glass plate (2) due to wind loads and temperature variations; each said clamping assembly (3, 4, 5) having a longitudinal dimension (11) configured to extend towards a connected glass plate (2) away from a building structure on which a clamping assembly (3, 4, 5) is mounted; said first clamping assembly (3) being configured to restrict movement of said glass plate supporting assembly (6, 7) of said first clamping assembly (3) in all radial directions with respect to said longitudinal dimension (11); said second clamping assembly (4) being configured to restrict movement of said glass plate supporting assembly (6, 7) of said second clamping assembly (4) in radial directions with respect to said longitudinal dimension (11) except for a back and forth movement in a radial direction with respect to said longitudinal dimension (11); said bush arrangement (9, 17) of said second clamping assembly (4) comprising a slot (12) being configured to be disposed to permit a back and forth movement of said glass plate supporting assembly (6, 7) of said second clamping assembly (4) in a radial direction with respect to said longitudinal dimension (11); and said third clamping assembly (5) being configured to permit movement of said glass plate supporting assembly (6, 7) of said third clamping assembly (5) in all radial directions with respect to said longitudinal dimension (11); said bush arrangement (9, 17) of said third clamping assembly (5) comprising a compensating bush (17) and a spacer bush (9); both said bushes (9, 17) being configured to be disposed concentrically with radial clearance with respect to a one another, and both said bushes (9, 17) being configured to be disposed along said longitudinal dimension (11) about said clamp bolt (8) of said third clamping arrangement (5), to permit movement of said glass plate supporting assembly (6, 7) of said third clamping assembly (5) in all radial directions with respect to said longitudinal dimension (11); said clamping assemblies (3, 4, 5), upon assembly and installation with a glass plate (2) to a building structure, together being configured to: hold a glass plate (2) in a glass facade of a building structure; and compensate for tolerances of a glass plate (2), and for tolerances of a building structure on which said clamping assemblies (3, 4, 5) are installed; and further: a plurality of said clamping assemblies (3, 4, 5), upon assembly and installation with a glass plate (2) to a building structure, being configured to: compensate for differences in distance in the direction of said longitudinal dimension (11) between a building structure and a corresponding glass plate (2).

Another feature of the invention resides broadly in a kit to mount a glass plate (2) in a glass facade to a building structure, wherein: said clamp bolt (8) comprises a head portion (31) and a shank portion (16); said bush arrangement (9, 17) of said first clamping assembly (3) comprises: a compensating bush (17) being configured to be operatively disposed about said clamp bolt shank portion (16) along said longitudinal dimension (11); said compensating bush (17) of said first clamping assembly (3) comprises a first end portion being configured to be disposed towards a glass plate (2) upon installation with a glass plate (2), and said compensating bush (17) of said first clamping assembly (3) comprises a second end portion being configured to be disposed towards a building structure upon installation with a glass plate (2); said compensating bush first end portion being configured to operatively contact said clamp bolt head portion (31); said bush arrangement (9, 17) of said first clamping assembly (3) comprises: a spacer bush (9) being configured to be disposed about said compensating bush (17) of said first clamping assembly (3); said elastic material (30) which is configured to minimize stresses on a connected glass plate (2) due to wind loads and temperature variations being operatively disposed about said spacer bush (9); said bush arrangement (9, 17) of said first clamping assembly (3) comprises: a distance washer (21), and a nut member (20); said distance washer (21) being configured to be operatively disposed about said compensating bush (17) of said first clamping assembly (3) adjacent said second end portion of said compensating bush (17) of said first clamping assembly (3); and said nut element (20) being configured to be operatively disposed about said compensating bush (17) of said first clamping assembly (3) adjacent said distance washer (21), to restrict movement of said glass plate supporting assembly (6, 7) of said first clamping assembly (3) in all radial directions with respect to said longitudinal dimension (11).

Yet another feature of the invention resides broadly in a kit to mount a glass plate (2) in a glass facade to a building structure, wherein: said bush arrangement (9, 17) of said second clamping assembly (4) comprises: a compensating bush (17) being configured to be operatively disposed about said clamp bolt shank portion (16); and a spacer bush (9) being configured to be disposed about said compensating bush (17) of said second clamping assembly (4); said slot (12) which is configured to be disposed to permit a back and forth movement of said glass plate supporting assembly (6, 7) of said second clamping assembly (4) in a radial direction with respect to said longitudinal dimension (11) is disposed on said spacer bush (9).

Still another feature of the invention resides broadly in a kit to mount a glass plate (2) in a glass facade to a building structure, wherein: said compensating bush (17) of said third clamping assembly (5) comprises a flange portion (25); said spacer bush (9) of said third clamping assembly (5) being configured to be operatively disposed between said clamp bolt head portion (31) and said flange portion (25) of said compensating bush (17) of said third clamping assembly (5), to permit movement of said glass plate supporting assembly (6, 7) of said third clamping assembly (5) in all radial directions with respect to said longitudinal dimension (11).

A further feature of the invention resides broadly in a kit to mount a plurality of glass plates (2) of a building glass facade of a building structure, said kit comprising: a plurality of first clamping assemblies (3); a plurality of second clamping assemblies (4); and a plurality of third clamping assemblies (5); each said clamping assembly (3,4,5) comprising: a structure (8) being configured to operatively mount a corresponding clamping assembly (3, 4, 5) to a building structure; a glass plate supporting assembly (6, 7) being configured to be operatively connectable to said building mounting structure (8), and said glass plate mounting assembly (6, 7) being configured to support a glass plate (2) adjacent to a building structure; and an arrangement to provide elasticity between a building structure and a connected glass plate (2), said elastic arrangement (30) being configured to be operatively connectable to said glass plate supporting assembly (6, 7), and said elastic arrangement (30) comprising an elastic material; said elastic material being configured to minimize stresses on a connected glass plate (2) due to wind loads and temperature variations; each said clamping assembly (3, 4, 5) having a longitudinal dimension (11) configured to extend towards a connected glass plate (2) away from a building structure on which a clamping assembly (3, 4, 5) is mounted; said first clamping assembly (3) being configured to restrict movement of said glass plate supporting assembly (6, 7) of said first clamping assembly (3) in all radial directions with respect to said longitudinal dimension (11); said second clamping assembly (4) being configured to restrict movement of said glass plate supporting assembly (6, 7) of said second clamping assembly (4) in radial directions with respect to said longitudinal dimension (11) except for a back and forth movement in a radial direction with respect to said longitudinal dimension (11); and said third clamping assembly (5) being configured to permit movement of said glass plate supporting assembly (6, 7) of said third clamping assembly (5) in all radial directions with respect to said longitudinal dimension (11); said clamping assemblies (3, 4, 5), upon assembly and installation with a glass plate (2) to a building structure, together being configured to: hold a glass plate (2) in a glass facade of a building structure; and compensate for tolerances of a glass plate (2), and for tolerances of a building structure on which said clamping assemblies (3, 4, 5) are installed; and further: a plurality of said clamping assemblies (3, 4, 5), upon assembly and installation with a glass plate (2) to a building structure, being configured to: compensate for differences in distance in the direction of said longitudinal dimension (11) between a building structure and a corresponding glass plate (2).

Another feature of the invention resides broadly in a kit to mount a plurality of glass plates (2) of a building glass facade of a building structure, wherein: said mounting structure comprises a clamp bolt (8) comprising a head portion (31) and a shank portion (16); said first clamping assembly comprises a bush arrangement (9, 17); said bush arrangement (9, 17) of said first clamping assembly (3) comprises: a compensating bush (17) being configured to be operatively disposed about said clamp bolt shank portion (16) along said longitudinal dimension (11); said compensating bush (17) of said first clamping assembly (3) comprises a first end portion being configured to be disposed towards a glass plate (2) upon installation with a glass plate (2), and said compensating bush (17) of said first clamping assembly (3) comprises a second end portion being configured to be disposed towards a building structure upon installation with a glass plate (2); said compensating bush first end portion being configured to operatively contact said clamp bolt head portion (31); said bush arrangement (9, 17) of said first clamping assembly (3) comprises: a spacer bush (9) being configured to be disposed about said compensating bush (17) of said first clamping assembly (3); said elastic material (30) which is configured to minimize stresses on a connected glass plate (2) due to wind loads and temperature variations being operatively disposed about said spacer bush (9); said bush arrangement (9, 17) of said first clamping assembly (3) comprises: a distance washer (21), and a nut member (20); said distance washer (21) being configured to be operatively disposed about said compensating bush (17) of said first clamping assembly (3) adjacent said second end portion of said compensating bush (17) of said first clamping assembly (3); and said nut element (20) being configured to be operatively disposed about said compensating bush (17) of said first clamping assembly (3) adjacent said distance washer (21), to restrict movement of said glass plate supporting assembly (6, 7) of said first clamping assembly (3) in all radial directions with respect to said longitudinal dimension (11).

Yet another feature of the invention resides broadly in a kit to mount a plurality of glass plates (2) of a building glass facade of a building structure, wherein: said second clamping assembly (4) comprises a bush arrangement (9, 17); said bush arrangement of said second clamping assembly comprises: a compensating bush (17) being configured to be operatively disposed about said clamp bolt shank portion (16); and a spacer bush (9) being configured to be disposed about said compensating bush (17) of said second clamping assembly (4); said spacer bush (9) of said second clamping assembly (4) comprises a slot (12) being configured to be disposed to permit a back and forth movement of said glass plate supporting assembly (6, 7) of said second clamping assembly (4) in a radial direction with respect to said longitudinal dimension (11).

Still another feature of the invention resides broadly in a kit to mount a plurality of glass plates (2) of a building glass facade of a building structure, wherein: said third clamping assembly comprises: a compensating bush (17) comprising a flange portion (25); said third clamping assembly (5) comprises: a spacer bush (9) being configured to be disposed between said clamp bolt head portion (31) and said flange portion (25) of said compensating bush (17) of said third clamping assembly (5), to permit movement of said glass plate supporting assembly (6, 7) of said third clamping assembly (5) in all radial directions with respect to said longitudinal dimension (11).

A further feature of the invention resides broadly in a kit to mount a glass plate (2) in a glass facade to a building structure, said kit comprising: a first clamping assembly (3), a second clamping assembly (4), and a third clamping assembly (5); each said clamping assembly (3, 4, 5) comprising: a structure (8) being configured to operatively mount a corresponding clamping assembly (3, 4, 5) to a building structure; and a glass plate supporting assembly (6, 7) being configured to be operatively connectable to said building mounting structure (8), and said glass plate mounting assembly (6, 7) being configured to support a glass plate (2) adjacent to a building structure; each said clamping assembly (3, 4, 5) having a longitudinal dimension (11) configured to extend towards a connected glass plate (2) away from a building structure on which a clamping assembly (3, 4, 5) is mounted; said first clamping assembly (3) being configured to restrict movement of said glass plate supporting assembly (6, 7) of said first clamping assembly (3) in all radial directions with respect to said longitudinal dimension (11); said second clamping assembly (4) being configured to restrict movement of said glass plate supporting assembly (6, 7) of said second clamping assembly (4) in radial directions with respect to said longitudinal dimension (11) except for a back and forth movement substantially transverse to said longitudinal dimension (11); and said third clamping assembly (5) being configured to permit movement of said glass plate supporting assembly (6, 7) of said third clamping assembly (5) in all radial directions with respect to said longitudinal dimension (11); said clamping assemblies (3, 4, 5), upon assembly and installation with a glass plate (2) to a building structure, together being configured to hold a glass plate (2) in a glass facade of a building structure and also together being configured to compensate for tolerances of a glass plate (2), and for tolerances of a building structure on which said clamping assemblies (3, 4, 5) are installed.

Another feature of the invention resides broadly in a kit to mount a glass plate (2) in a glass facade to a building structure, wherein: said building mounting structure of each said clamping assembly (3, 4, 5) comprises: a clamp bolt (8) comprising a bolt head portion (31) and a bolt shank portion (16); each said clamping assembly (3, 4, 5) comprises: a compensating bush (17); and a spacer bush (9); said compensating bush (17) being configured to be operatively disposed about said bolt shank portion (16); and said spacer bush (9) being configured to be operatively disposed about said compensating bush (17).

Yet another feature of the invention resides broadly in a kit to mount a glass plate (2) in a glass facade to a building structure, wherein: said spacer bush (9) comprises a collar portion (24); said compensating bush (17) comprises an externally threaded portion (29); each said clamping assembly (3, 4, 5) comprises a nut member (20); said compensating bush (17) being configured to operatively contact said spacer bush collar (24); said nut member (20) being configured to restrict movement of said spacer bush (9) upon being threaded onto said compensating bush externally threaded portion (29). Still another feature of the invention resides broadly in a kit to mount a glass plate (2) in a glass facade to a building structure, wherein: said glass plate supporting assembly (6, 7) of each said clamping assembly (3, 4, 5) comprises: a first clamp element (7) configured to be disposed away from a building structure upon installation with a glass plate (2) to a building structure; and a second clamp element (6) configured to be disposed between said first clamp element (7) and a building structure upon installation with a glass plate (2) to a building structure; said second clamp element (6) comprising a cylindrical recess (10) configured to operatively mount therein said clamp bolt (8), said compensating bush (17), and said spacer bush (9).

A further feature of the invention resides broadly in a kit to mount a glass plate (2) in a glass facade to a building structure, wherein: each said clamping assembly (3, 4, 5) comprises an arrangement (30) to provide elasticity between a building structure and a connected glass plate (2), said elastic arrangement (30) being configured to be operatively connectable to said glass plate supporting assembly (6,7), and said elastic arrangement (30) comprising an elastic material; said elastic material being configured to minimize stresses on a connected glass plate due to wind loads and temperature variations; said spacer bush (9) comprises a flange portion (18) being configured to be operatively contacted by said elastic arrangement (30).

Another feature of the invention resides broadly in a kit to mount a glass plate (2) in a glass facade to a building structure, wherein: said elastic arrangement (30) comprises a pair of O-rings operatively disposed about said spacer bush (9).

Yet another feature of the invention resides broadly in a kit to mount a glass plate (2) in a glass facade to a building structure, wherein: said compensating bush (17) of said first clamping assembly (3) is configured to be secured to restrict movement of said glass plate supporting assembly (6, 7) of said first clamping assembly (3) in all radial directions with respect to said longitudinal dimension (11).

Still another feature of the invention resides broadly in a kit to mount a glass plate (2) in a glass facade to a building structure, wherein: each said first clamping assembly (3) comprises: a distance washer (21) being configured to be operatively disposed between said nut member (20) and said spacer bush (9).

A further feature of the invention resides broadly in a kit to mount a glass plate (2) in a glass facade to a building structure, wherein: said spacer bush (9) of said second clamping assembly (4) comprises a collar portion (24) and a slot (12); said compensating bush (17) of said second clamping assembly (4) comprises a bush head portion (23); said compensating bush head portion (23) being configured to be operatively disposed in said slot (12) and adjacent said spacer bush collar portion (24).

Another feature of the invention resides broadly in a kit to mount a glass plate (2) in a glass facade to a building structure, wherein: said spacer bush (9) of said second clamping assembly (4) is configured to be operatively positioned about said compensating bush (17) of said second clamping assembly (4), to permit movement of said spacer bush (9) of said second clamping assembly (4) in reference to said nut member (20).

Yet another feature of the invention resides broadly in a kit to mount a glass plate (2) in a glass facade to a building structure, wherein: said compensating bush (17) and said spacer bush (9) of said third clamping arrangement (5) are configured to be concentrically disposed with respect to one another; said compensating bush (17) of said third clamping assembly (5) comprising a collar portion (25); said spacer bush (9) of said third clamping assembly (5) being configured to be operatively disposed between said clamp bolt head portion (31) and said collar portion (25) of said compensating bush (17) of said third clamping assembly (5).

Still another feature of the invention resides broadly in a kit to mount a glass plate (2) in a glass facade to a building structure, wherein: each said clamping assembly (3, 4, 5) comprises a locknut (26) being configured to operatively engage said externally threaded portion (29) of its compensating bush (17) to secure a corresponding clamping assembly (3, 4, 5) to a building structure.

One feature of the invention resides broadly in a clamp fixture for fastening glass plates with an outer clamp element and an inner clamp element that clamp the glass plate between them and a clamp bolt that can be connected with a substructure, which clamp bolt is supported elastically, to a limited extent, on the inner clamp element by means of a bush that surrounds the clamp bolt, characterized by the fact that the inner clamp element 6, on the side facing the substructure, has a cylindrical receptacle space 10 to hold a bearing 3, 4, 5 that supports the clamp bolt 8 in the axial direction Arrow Z, whereby the clamp bolt 8 can be supported optionally in the axial direction Arrow Z without play fixed bearing, in a plane that intersects the center longitudinal axis 11 and in the axial direction Arrow Z with play 12, 13 (friction bearing 4), or with axial play 14 and play 15 on all sides in the peripheral direction movable bearing 5 in the bearing 3, 4, 5.

Another feature of the invention resides broadly in a clamp fixture characterized by the fact that the bearing 3, 4, 5 has a compensating bush 17 that surrounds a bolt shank 16 of the clamp bolt 18 without play, and a spacer bush 9 that surrounds the compensating bush 17.

Yet another feature of the invention resides broadly in a clamp fixture characterized by the fact that the spacer bush 9, on its outer periphery, has a flange 18, by means of which the bearing 3, 4, 5 is supported to a limited elastic extend by means of elastic means O-rings 30 on the inner clamp element 6.

Still another feature of the invention resides broadly in a clamp fixture characterized by the fact that to achieve a fixed bearing 3, the compensating bush 17 is fixed in position in the axial direction Arrow Z on the spacer bush 9.

A further feature of the invention resides broadly in a clamp fixture characterized by the fact that the compensating bush 17 is supported on one hand on a collar 24 of the spacer bush 9 and on the other hand by means of a nut 20 that is screwed together with the compensating bush 17 on the spacer bush 9.

Another feature of the invention resides broadly in a clamp fixture characterized by the fact that a distance washer 21 is located between the nut 20 and the end surface of the spacer bush 9.

Yet another feature of the invention resides broadly in a clamp fixture characterized by the fact that the spacer bush 9 has a recess or hole that has a slot-shaped cross section, and the compensating bush 17 is supported with an essentially oval or elliptical bush head 23 on a collar 24 of the spacer bush 9.

Still another feature of the invention resides broadly in a clamp fixture characterized by the fact that to achieve a friction bearing 4, there is axial play 13 between the nut 20 that is screwed to the compensating bush 17 and the spacer bush 9.

A further feature of the invention resides broadly in a clamp fixture characterized by the fact that to achieve a movable bearing 5, both the compensating bush 17 and the spacer bush 9 have concentric borings, whereby the spacer bush 9 surrounds the compensating bush 17 with radial play or clearance 15 and is mounted with axial play 14 between a bolt head 31 of the clamp bolt and a flange 25 of the compensating bush 17.

Another feature of the invention resides broadly in a clamp fixture characterized by the fact that the compensating bush 17 has a threaded sleeve 32 that points toward the substructure to accept a locknut 26.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 199 38 571.8 , filed on Aug. 17, 1999, having inventors Ralf KREYENBORG, Dirk SCHULTE, and Ernst Udo BLÖBAUM, and International Application No. PCT/EP00/07941, filed on Aug. 15, 2000, having inventors Ralf KREYENBORG, Dirk SCHULTE, and Ernst Udo BLÖBAUM, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. Pat. No. 6,158,177, having inventor Blöbaum, issued on Dec. 12, 2000 is hereby incorporated by reference as if set forth in its entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

Some examples of glass mountings or glass mounting devices which may possibly be utilized or adapted for use in the context of the present invention may be found in the following U.S. Pat. No. : 5,323,577, issued on Jun. 28, 1994 to Witmyer; U.S. Pat. No. 5,283,978, issued on Feb. 8, 1994 to Horgan, Jr.; U.S. Pat. No. 5,212,922, issued on May 25, 1993 to Werner: U.S. Pat. No. 4,841,697, issued on Jun. 27, 1989 to Hogg, et al.; U.S. Pat. No. 4,097,320, issued on Oct. 18, 1977 to Sher; and U.S. Pat. No. 4,016,690, issued on Apr. 12, 1997 to Richardson.

Some examples of glass facades and methods of securing glass panels of a facade which may possibly be utilized or adapted for use in the context of the present invention may be found in the following U.S. patents. Nos.: U.S. Pat. No. 5,493,831, issued on Feb. 27, 1996 to Jansson: U.S. Pat. No. 5,301,484, issued on Apr. 12, 1994 to Jansson; U.S. Pat. No. 4,837,996, issued on Jun. 13, 1989 to Eckelt; and U.S. Pat. No. 4,793,112, issued on Dec. 27, 1988 to Sufke.

NOMENCLATURE

| | |
|---|---|
| 1 | Clamp fitting |
| 2 | Glass plate |
| 3 | Fixed bearing |
| 4 | Friction bearing |
| 5 | Movable bearing |
| 6 | Inner clamp element |
| 7 | Outer clamp element |
| 8 | Clamp bolt |
| 9 | Spacer bush |
| 10 | Cylindrical receptacle space |
| 11 | Center longitudinal axis |
| 12 | Play |
| 13 | Play |
| 14 | Play |
| 15 | Play |
| 16 | Bolt shank |
| 17 | Compensating bush |
| 18 | Flange |
| 19 | Shim washer |
| 20 | Nut |
| 21 | Distance washer |
| 22 | Slot-shaped recess |
| 23 | Bush head |
| 24 | Collar of distance washer |
| 25 | Flange |
| 26 | Locknut |
| 27 | Tension ring |
| 28 | Stud screw |
| 29 | Thread |
| 30 | O-rings |
| 31 | Bolt head of the clamp bolt |
| 32 | Threaded sleeve |
| Arrow Z | Axial direction |
| F | Fixed bearing |
| V | Vertical bearing |
| L | Movable bearing |
| X | Direction |
| Y | Direction |
| 101 | Substructure |
| 102 | Collar/flange |
| 103 | Collar/flange |
| 104 | Screw hole |
| 105 | Screw hole |
| 106 | Protecting sleeve/tight bushing |
| 107 | Protecting sleeve/tight bushing |

What is claimed is:

1. A kit to mount a glass plate in a glass facade to a building structure, said kit comprising:

a plurality of clamping assemblies;

each clamping assembly of said plurality of clamping assemblies comprising:

a building mounting structure being configured to operatively mount each said clamping assembly to a building structure;

said building mounting structure comprising:

a clamp bolt being configured to be operatively connectable to a building structure;

said clamp bolt having a center longitudinal axis; and a bush arrangement being configured to be operatively connectable to said clamp bolt;

a glass plate supporting assembly being configured to be operatively connectable to said building mounting structure, and said glass plate supporting assembly being configured to support a glass plate adjacent to a building structure;

said glass plate supporting assembly comprising:

a first clamp element configured to be disposed away from a building structure upon installation with a glass plate to a building structure;

a second clamp element configured to be disposed between said first clamp element and a building structure upon installation with a glass plate to a building structure; and said second clamp element comprising a cylindrical recess configured to operatively mount therein said clamp bolt and said bush arrangement;

an elastic arrangement to provide elasticity between a building structure and a glass plate, said elastic arrangement being configured to be operatively connectable to said bush arrangement of said building mounting structure, and said elastic arrangement comprising an elastic material;

said elastic material being configured to minimize stresses on a glass plate due to wind loads and temperature variations;

said plurality of clamping assemblies comprising at least a first clamping assembly, a second clamping assembly, and a third clamping assembly;

said first clamping assembly being configured to restrict movement of said glass plate supporting assembly of said first clamping assembly in all radial directions with respect to said center longitudinal axis;

said second clamping assembly being configured to restrict movement of said glass plate supporting assembly of said second clamping assembly in radial directions with respect to said center longitudinal axis except for a back and forth movement in a radial direction with respect to said center longitudinal axis;

said bush arrangement of said second clamping assembly comprising a slot being configured to be disposed to permit a back and forth movement of said glass plate supporting assembly of said second clamping assembly in a radial direction with respect to said center longitudinal axis;

said third clamping assembly being configured to permit movement of said glass plate supporting assembly of said third clamping assembly in all radial directions with respect to said center longitudinal axis;

said bush arrangement of said third clamping assembly comprising a compensating bush and a spacer bush, both said bushes being configured to be disposed concentrically with radial clearance with respect to one another, and both said bushes being configured to be disposed along said center longitudinal axis about said clamp bolt of said third clamping assembly to permit movement of said glass plate supporting assembly of said third clamping assembly in all radial directions with respect to said center longitudinal axis;

said plurality of clamping assemblies, upon assembly and installation with a glass plate to a building structure, together being configured to:

hold a glass plate in a glass facade of a building structure;

compensate for tolerances of a glass plate, and for tolerances of a building structure on which said clamping assemblies are installed; and compensate for differences in distance in the direction of said center longitudinal axis between a building structure and a glass plate;

said clamp bolt comprises a head portion and a shank portion;

said bush arrangement of said first clamping assembly comprises:

a compensating bush being configured to be operatively disposed about said clamp bolt shank portion along said center longitudinal axis;

said compensating bush of said first clamping assembly comprises a first end portion being configured to be disposed towards a glass plate upon installation with a glass plate, and said compensating bush of said first clamping assembly comprises a second end portion being configured to be disposed towards a building structure upon installation with a glass plate;

said compensating bush first end portion being configured to operatively contact said clamp bolt head portion;

said bush arrangement of said first clamping assembly further comprises:

a spacer bush being configured to be disposed about said compensating bush of said first clamping assembly;

said elastic material of said first and third clamping assemblies, which is configured to minimize stresses on a glass plate due to wind loads and temperature variations, being operatively disposed about said spacer bush;

said bush of said first and third clamping assemblies, respectively arrangement of said first clamping assembly further comprises:

a distance washer, and a nut member;

said distance washer being configured to be operatively disposed about said compensating bush of said first clamping assembly adjacent said second end portion of said compensating bush of said first clamping assembly; and said nut element being configured to be operatively disposed about said compensating bush of said first clamping assembly adjacent said distance washer, to restrict movement of said glass plate supporting assembly of said first clamping assembly in all radial directions with respect to said center longitudinal axis.

2. The kit according to claim 1, wherein:

said bush arrangement of said second clamping assembly comprises:

a compensating bush being configured to be operatively disposed about said clamp bolt shank portion; and a spacer bush being configured to be disposed about said compensating bush of said second clamping assembly;

said slot which is configured to be disposed to permit a back and forth movement of said glass plate supporting assembly of said second clamping assembly in a radial direction with respect to said center longitudinal axis is disposed on said spacer bush.

3. The kit according to claim 2, wherein:

said compensating bush of said third clamping assembly comprises a flange portion;

said spacer bush of said third clamping assembly being configured to be operatively disposed between said clamp bolt head portion and said flange portion of said compensating bush of said third clamping assembly, to permit movement of said glass plate supporting assembly of said third clamping assembly in all radial directions with respect to said center longitudinal axis.

4. A kit to mount a plurality of glass plates of a building glass facade of a building structure, said kit comprising:

a plurality of first clamping assemblies;

a plurality of second clamping assemblies; and a plurality of third clamping assemblies;

each said clamping assembly comprising:

a building mounting structure being configured to operatively mount each said clamping assembly to a building structure;

said mounting structure comprises a clamp bolt comprising a head portion and a shank portion, said shank portion having a center longitudinal axis;

a glass plate supporting assembly being configured to be operatively connectable to said building mounting structure, and said glass plate mounting assembly being configured to support a glass plate adjacent to a building structure; and an elastic arrangement to provide elasticity between a building structure and a glass plate, said elastic arrangement being configured to be operatively connectable to said glass plate supporting assembly, and said elastic arrangement comprising an elastic material;

said elastic material being configured to minimize stresses on a glass plate due to wind loads and temperature variations;

said first clamping assembly being configured to restrict movement of said glass plate supporting assembly of said first clamping assembly in all radial directions with respect to said center longitudinal axis;

said second clamping assembly being configured to restrict movement of said glass plate supporting assembly of said second clamping assembly in radial directions with respect to said center longitudinal axis except for a back and forth movement in a radial direction with respect to said center longitudinal axis; and said third clamping assembly being configured to permit movement of said glass plate supporting assembly of said third clamping assembly in all radial directions with respect to said center longitudinal axis;

said clamping assemblies, upon assembly and installation with a glass plate to a building structure, together being configured to:

hold a glass plate in a glass facade of a building structure;

compensate for tolerances of a glass plate, and for tolerances of a building structure on which said clamping assemblies are installed; and compensate for differences in distance in the direction of said center longitudinal axis between a building structure and a glass plate;

said first clamping assembly comprises a bush arrangement;

said bush arrangement of said first clamping assembly comprises:

a compensating bush being configured to be operatively disposed about said clamp bolt shank portion along said center longitudinal axis;

said compensating bush of said first clamping assembly comprises a first end portion being configured to be disposed towards a glass plate upon installation with a glass plate, and said compensating bush of said first clamping assembly comprises a second end portion being configured to be disposed towards a building structure upon installation with a glass plate;

said compensating bush first end portion being configured to operatively contact said clamp bolt head portion;

said bush arrangement of said first clamping assembly further comprises:

a spacer bush being configured to be disposed about said compensating bush of said first clamping assembly;

said elastic materials of said first clamping assembly which is configured to minimize stresses on a glass plate due to wind loads and temperature variations being operatively disposed about said spacer bush;

said bush arrangement of said first clamping assembly further comprises:

a distance washer, and a nut member;

said distance washer being configured to be operatively disposed about said compensating bush of said first clamping assembly adjacent said second end portion of said compensating bush of said first clamping assembly; and said nut element being configured to be operatively disposed about said compensating bush of said first clamping assembly adjacent said distance washer, to restrict movement of said glass plate supporting assembly of said first clamping assembly in all radial directions with respect to said center longitudinal axis.

5. The kit according to claim 4, wherein:

said second clamping assembly comprises a bush arrangement;

said bush arrangement of said second clamping assembly comprises:

a compensating bush being configured to be operatively disposed about said clamp bolt shank portion; and a spacer bush being configured to be disposed about said compensating bush of said second clamping assembly;

said spacer bush of said second clamping assembly comprises a slot being configured to be disposed to permit a back and forth movement of said glass plate supporting assembly of said second clamping assembly in a radial direction with respect to said center longitudinal axis.

6. The kit according to claim 5, wherein:

said third clamping assembly comprises:

a compensating bush comprising a flange portion;

said third clamping assembly comprises:

a spacer bush being configured to be disposed between said clamp bolt head portion and said flange portion of said compensating bush of said third clamping assembly, to permit movement of said glass plate supporting assembly of said third clamping assembly in all radial directions with respect to said center longitudinal axis.

7. A kit to mount a glass plate in a glass facade to a building structure, said kit comprising:

a first clamping assembly, a second clamping assembly, and a third clamping assembly;

each said clamping assembly comprising:

a building mounting structure being configured to operatively mount each said clamping assembly to a building structure; and said building mounting structure of each said clamping assembly comprises:

a clamp bolt comprising a bolt head portion and a bolt shank portion, said bolt shank portion having a center longitudinal axis;

a glass plate supporting assembly being configured to be operatively connectable to said building mounting structure, and said glass plate mounting assembly being configured to support a glass plate adjacent to a building structure;

said first clamping assembly being configured to restrict movement of said glass plate supporting assembly of said first clamping assembly in all radial directions with respect to said center longitudinal axis;

said second clamping assembly being configured to restrict movement of said glass plate supporting assembly of said second clamping assembly in radial directions with respect to said center longitudinal axis except for a back and forth movement substantially transverse to said center longitudinal axis; and said third clamping assembly being configured to permit movement of said glass plate supporting assembly of said third clamping assembly in all radial directions with respect to said center longitudinal axis;

said clamping assemblies, upon assembly and installation with a glass plate to a building structure, together being configured to hold a glass plate in a glass facade of a building structure and also together being configured to compensate for tolerances of a glass plate, and for tolerances of a building structure on which said clamping assemblies are installed;

each said clamping assembly further comprises:

a compensating bush; and a spacer bush;

said compensating bush being configured to be operatively disposed about said bolt shank portion; and said spacer bush being configured to be operatively disposed about said compensating bush.

8. The kit according to claim 7, wherein:

said spacer bush comprises a collar portion;

said compensating bush comprises an externally threaded portion;

each said clamping assembly comprises a nut member;

said compensating bush being configured to operatively contact said spacer bush collar;

said nut member being configured to restrict movement of said spacer bush upon being threaded onto said compensating bush externally threaded portion.

9. The kit according to claim 8, wherein:

said glass plate supporting assembly of each said clamping assembly comprises:

a first clamp element configured to be disposed away from a building structure upon installation with a glass plate to a building structure; and a second clamp element configured to be disposed between said first clamp element and a building structure upon installation with a glass plate to a building structure;

said second clamp element comprising a cylindrical recess configured to operatively mount therein said clamp bolt, said compensating bush, and said spacer bush.

10. The kit according to claim 9, wherein:

each said clamping assembly comprises an elastic arrangement to provide elasticity between a building structure and a glass plate, said elastic arrangement being configured to be operatively connectable to said glass plate supporting assembly, and said elastic arrangement comprising an elastic material;

said elastic material being configured to minimize stresses on a glass plate due to wind loads and temperature variations;

said spacer bush comprises a flange portion being configured to be operatively contacted by said elastic arrangement.

11. The kit according to claim 10, wherein:

said elastic arrangement comprises a pair of O-rings operatively disposed about said spacer bush.

12. The kit according to claim 11, wherein:

said compensating bush of said first clamping assembly is configured to be secured to restrict movement of said glass plate supporting assembly of said first clamping assembly in all radial directions with respect to said center longitudinal axis.

13. The kit according to claim 12, wherein:

each said first clamping assembly comprises:

a distance washer being configured to be operatively disposed between said nut member and said spacer bush.

14. The kit according to claim 13, wherein:

said spacer bush of said second clamping assembly comprises a collar portion and a slot;

said compensating bush of said second clamping assembly comprises a bush head portion;

said compensating bush head portion being configured to be operatively disposed in said slot and adjacent said spacer bush collar portion.

15. The kit according to claim 14, wherein:

said spacer bush of said second clamping assembly is configured to be operatively positioned about said compensating bush of said second clamping assembly, to permit movement of said spacer bush of said second clamping assembly in reference to said nut member.

16. The kit according to claim 15, wherein:

said compensating bush and said spacer bush of said third clamping arrangement are configured to be concentrically disposed with respect to one another;

said compensating bush of said third clamping assembly comprising a collar portion;

said spacer bush of said third clamping assembly being configured to be operatively disposed between said clamp bolt head portion and said collar portion of said compensating bush of said third clamping assembly.

17. The kit according to claim 16, wherein:

each said clamping assembly comprises a locknut being configured to operatively engage said externally threaded portion of said compensating bush to secure each said clamping assembly to a building structure.

* * * * *

UNITED STATES PATENT AND TRADEMARK OFFICE

CERTIFICATE OF CORRECTION

PATENT NO. : 6,623,203 B2 
DATED : September 23, 2003
INVENTOR(S) : Ralf Kreyenborg and Dirk Schulte It is certified that error appears in the above-identified patent and that said Letters Patent is hereby corrected as shown below:

Column 17,
Line 45, delete "bush;" and insert -- bush of said first and third clamping assemblies, respectively; --.
Lines 46 and 47, delete "of said first and third clamping assemblies, respectively".

Column 19,
Line 31, after "elastic" delete "materials" and insert -- material --.

Signed and Sealed this

Seventeenth Day of February, 2004

JON W. DUDAS
*Acting Director of the United States Patent and Trademark Office*